US005634824A

United States Patent [19]

Yagi et al.

[11] Patent Number: 5,634,824

[45] Date of Patent: Jun. 3, 1997

[54] METHOD OF AND CONSTRUCTION FOR FITTING OPTIONAL CONNECTOR RELATIVE TO HIGH-DENSITY MULTI-POLE CONNECTOR

[75] Inventors: Sakai Yagi; Toru Nagano; Tamio Watanabe; Michitaka Kinoshita, all of Shizuoka, Japan

[73] Assignee: Yazaki Corporation, Tokyo, Japan

[21] Appl. No.: 489,952

[22] Filed: Jun. 13, 1995

[30] Foreign Application Priority Data

Jun. 17, 1994 [JP] Japan ..... 6-135972

[51] Int. Cl.[6] ..... H01R 13/502

[52] U.S. Cl. ..... 439/701

[58] Field of Search ..... 439/701, 364, 439/686, 690, 695, 359, 717, 170, 171, 540.1

[56] References Cited

U.S. PATENT DOCUMENTS 4,469,393 9/1984 Chewning ..... 439/717

5,454,733 10/1995 Watanabe et al. ..... 439/540.1

FOREIGN PATENT DOCUMENTS 3-226978 10/1991 Japan ..... H01R 13/639

*Primary Examiner*—Neil Abrams

*Assistant Examiner*—Yong Kim

*Attorney, Agent, or Firm*—Sughrue, Mion, Zinn, Macpeak & Seas

[57] ABSTRACT

A female connector member of an optional connector is releasably connected to a female connector member of a high-density multi-pole connector in an integral manner, and a male connector member of the optional connector is releasably connected to a male connector member of the high-density multi-pole connector in an integral manner. The integrally-connected male connector members are connected respectively to the integrally-connected female connector members at one time.

7 Claims, 8 Drawing Sheets

METHOD OF AND CONSTRUCTION FOR FITTING OPTIONAL CONNECTOR RELATIVE TO HIGH-DENSITY MULTI-POLE CONNECTOR

BACKGROUND OF THE INVENTION

1. Field of the Invention

This invention relates to a high-density multi-pole connector used for interconnecting groups of terminals of wire harnesses, for example, in a vehicle, and more particularly to an improved method of and apparatus for connecting an optional connector to the high-density multi-pole connector in juxtaposed relation thereto.

2. Background

Generally, in a high-density multi-pole connector of this type used for connecting wire harnesses together, there has heretofore been used a bracket 101 for mounting the connector on a relevant portion of a vehicle, as shown in FIG. 12. The following method has been used for attaching an optional connector 103 of a general purpose-type (which comprises female and male connector members) to the high-density multi-pole connector 102 (which comprises female and male connector members) in juxtaposed relation thereto.

The male connector member of the high-density multi-pole connector 102 is beforehand mounted in a frame 101*a* of the vehicle-mounting bracket 101, and the female connector member is fitted on this male connector member from the lower side. Then, these connector members are fastened together by a bolt and a nut, so that they are maintained in a predetermined connected condition. Then, a housing mounting retaining portion 104 for attaching the optional connector 103 to the high-density multi-pole connector 102 in juxtaposed relation thereto is provided on the frame 101*a* of the bracket 101. A housing retaining portion 105, formed on the female connector member of the optional connector 103, is manually fitted in the housing mounting retaining portion 104, and then the male connector member is fitted into this female connector member.

However, in the above arrangement in which the optional connector 103 is attached to the high-density multi-pole connector 102 in juxtaposed relation thereto, it is necessary at first to fit the female and male connector members of the high-density multi-pole connector 102 together and also to fasten these connector members together by the bolt and the nut. Then, the housing retaining portion on the female connector member of the optional connector 103 is retainingly connected to the housing mounting retaining portion 104 formed on the frame 101*a* of the vehicle mounting bracket 101. Then, the male connector member is fitted in and connected to this female connector member.

Thus, the fitting of the female and male connector members of the high-density multi-pole connector 102 and the fitting of the female and male connector members of the optional connector 103, which are not necessarily effected separately from each other, must be carried out separately. This is disadvantageous that the connecting operation is quite cumbersome, and in that the same problem is encountered when effecting maintenance.

In view of the necessity of mounting an optional connector in juxtaposed relation to a high-density multi-pole connector, another conventional high-density multi-pole connector has a cavity or empty connector portion for receiving the optional connector. When it is necessary to add such optional connector depending on the type of harness, the optional connector is received in the empty connector portion. When it is not necessary to provide any optional connector, the empty connector portion is closed by a lid, and in some cases a provisional connector is provided there.

In this construction, the empty connector portion is always present in the high-density multi-pole connector (which tends to become more complicated in construction) regardless of whether or not the optional connector is needed, and, space within the high-density multi-pole connector can not be utilized efficiently.

As the number of required connectors is increased in accordance with the design of various harnesses, and time and labor required for connecting internal wiring also increase, and incomplete fitting of the optional connectors occurs at a higher rate. Such such a situation can not satisfactorily be dealt with by the above conventional fitting method.

SUMMARY OF THE INVENTION

The present invention has been made to overcome the above problems, and an object of the invention is to provide a method and apparatus for fitting an optional connector to a high-density multi-pole connector, in which the optional connector can be provided in juxtaposed relation to the high-density multi-pole connector, and an increased number of required connectors can be dealt with easily and satisfactorily, and the fitting of all of connector members in the high-density multi-pole connector and the optional connector can be made at the same time.

The above object has been achieved by a method of fitting an optional connector relative to a high-density multi-pole connector in juxtaposed relation thereto, wherein the high-density multi-pole connector comprises a pair of female and male connector members having their respective connection terminals to be connected together, and the optional connector comprises a pair of female and male connector members having their respective connection terminals to be connected together; such that one of the two connector members of the optional connector is releasably connected to one of the two connector members of the high-density multi-pole connector in an integral manner; the other connector member of the optional connector is releasably connected to the other connector member of the high-density multi-pole connector in an integral manner; and the integrally-connected one connector members are fitted and connected to the integrally-connected other connector members, respectively, at the same time.

In the above method of fitting the optional connector relative to the high-density multi-pole connector, the fitting connection between the integrally-connected one connector members and the integrally-connected other connector members at a time is effected with the aid of a guide member formed in a direction of connection.

The object of the invention has been achieved by relative fitting an optional connector relative to a high-density multi-pole connector in juxtaposed relation thereto, wherein the high-density multi-pole connector comprises a pair of female and male connector members each mounted in a frame; the female and male connector members have their respective connection terminals to be connected together, and the optional connector comprises a pair of female and male connector members having their respective connection terminals to be connected together. A frame-side engagement member is provided on the frame of each of the two connector members of the high-density multi-pole connector; a housing-side engagement member is provided on a housing of each of the two connector members of the optional connector; and each of the housing-side engagement means is releasably engaged with a respective one of the frame-side engagement members.

In the construction of fitting the optional connector relative to the high-density multi-pole connector, a guide member is provided on at least one of the mating frame-side engagement member and housing-side engagement member for guiding the other in a direction of connection.

In the method of fitting the optional connector to the high-density multi-pole connector according to the invention, the one connector member of the optional connector is releasably connected to the connector member of the high-density multi-pole connector in an integral manner, and the other connector member of the optional connector is releasably connected to the other connector member of the high-density multi-pole connector in an integral manner, and the integrally-connected one connector members are fitted and connected to the integrally-connected other connector members, respectively, so that the connection terminals of the one connector members are all connected respectively to the connection terminals of the other connector members at the same time.

In the method of fitting the optional connector to the high-density multi-pole connector, the fitting connection between the integrally-connected one connector members and the integrally-connected other connector members is effected with the aid of the guide member formed in the direction of connection. Therefore, the terminal connections are connected together accurately and smoothly.

In the construction of fitting the optical connector to the high-density multi-pole connector, the frame-side engagement member is provided on an outer surface of the frame of each of the two connector members of the high-density multi-pole connector, and the housing-side engagement member is provided on the housing of each of the two connector members of the optional connector, and each of the housing-side engagement members is releasably engaged with a respective one of the frame-side engagement member.

Therefore, by engaging the housing-side engagement member with the frame-side engagement member, the one connector members of the high-density multi-pole connector and the optional connector, as well as the other connector members, are integrally connected together. By doing so, the integrally-connected one connector members can be fitted relative to the integrally-connected other connector members, respectively, at the same time.

In the construction of fitting the optional connector relative to the high-density multi-pole connector, the guide member is provided on at least one of the mating frame-side engagement member and housing-side engagement member for guiding the other in the direction of connection. Therefore, the fitting connection between each pair of mating connection terminals is guided by the guide member, so that the fitting connection can be carried out accurately and smoothly.

DETAILED DESCRIPTION OF THE PREFERRED EMBODIMENTS

A method of and a construction for fitting optional connectors relative to a high-density multi-pole connector according to the present invention will now be described with reference to FIGS. 1 to 11.

Figure 1:
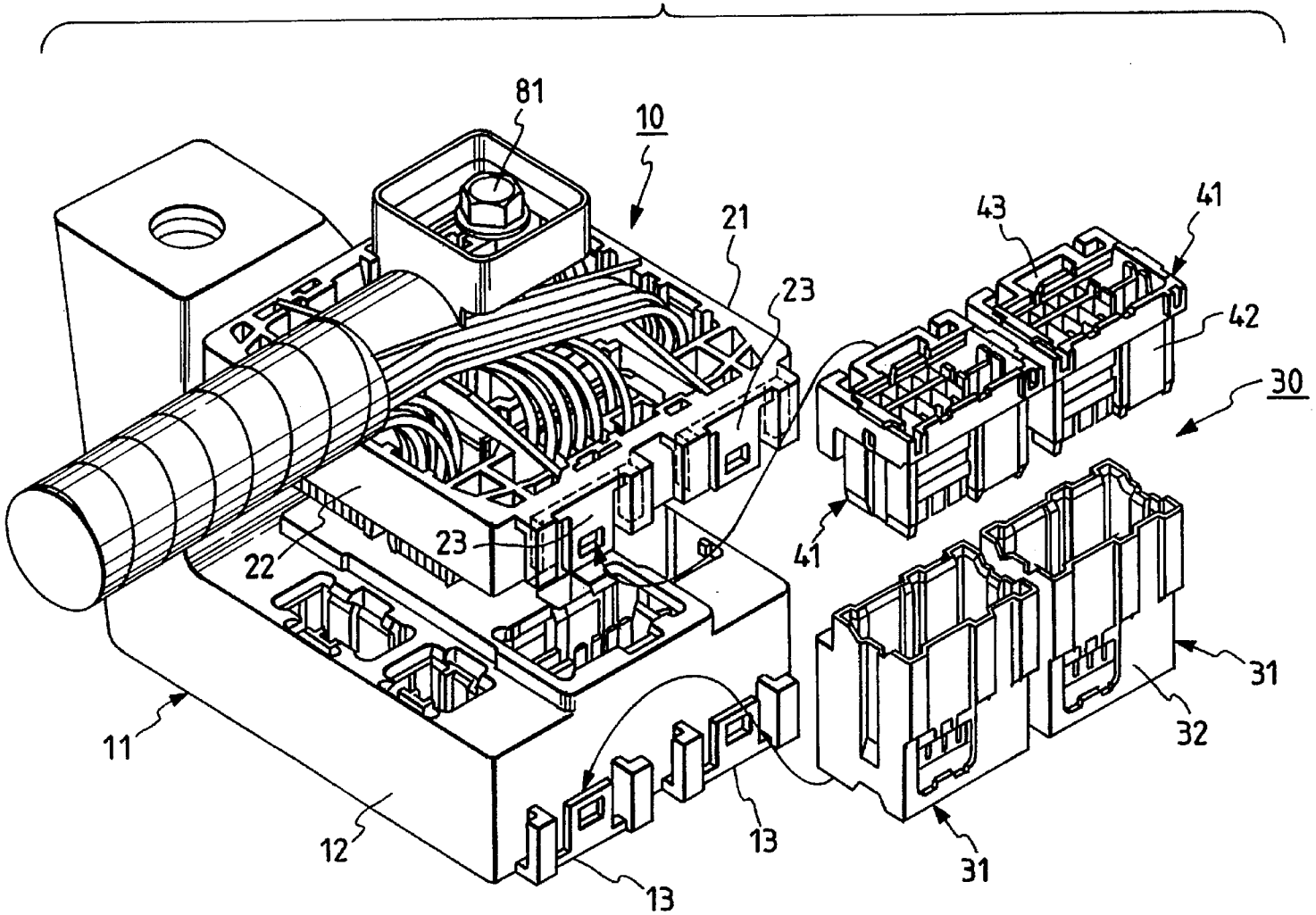
FIG. 1 is a perspective view of a high-density multi-pole connector, to which a preferred embodiment of a construction of the invention for fitting an optional connector is applied, showing a condition before the connection is made.
Figure 2:
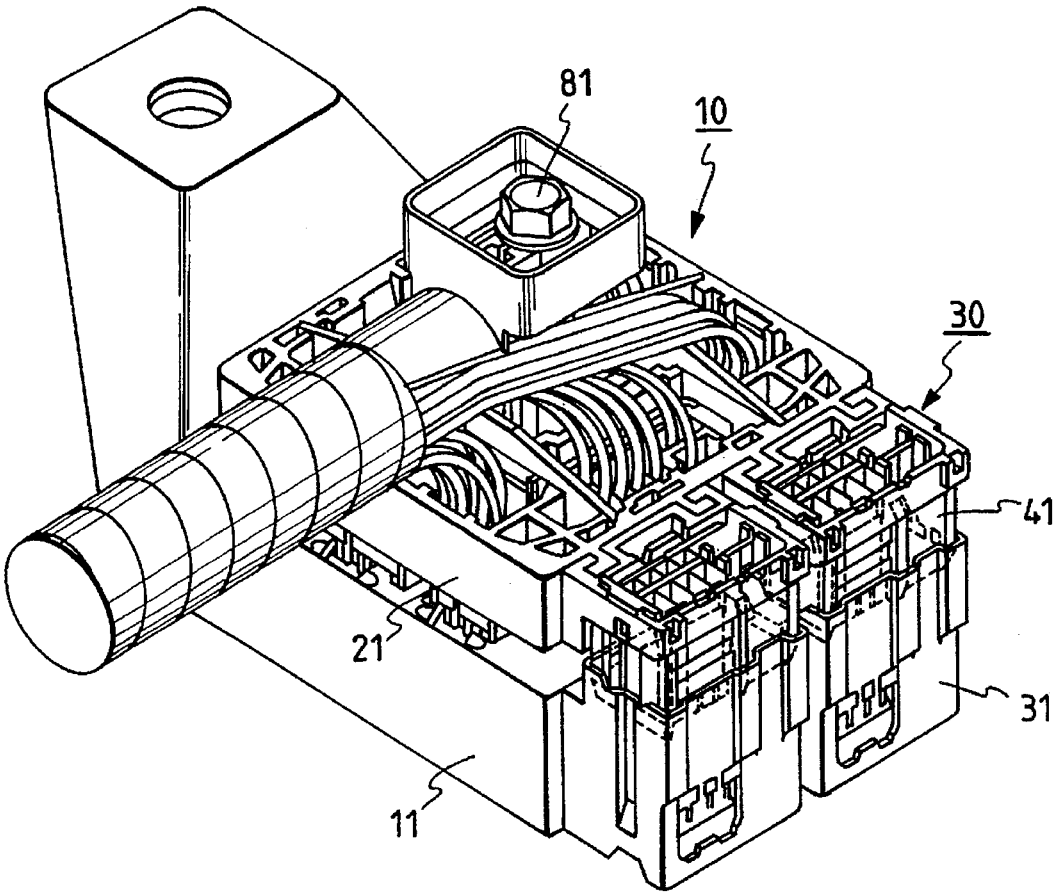
FIG. 2 is a perspective view of the connector of FIG. 1, showing a condition after the connection is made.

FIGS. 1 and 2 are a perspective view showing a general construction of the high-density multi-pole connector to which the optional connector-fitting construction of the invention is applied, and FIG. 1 shows a condition before the connectors are connected while FIG. 2 shows a condition after the connectors are connected.

In this embodiment shown in FIGS. 1 and 2, the high-density multi-pole connector 10 comprises female and male connector members 11 and 21 of a conventional construction, and each optional connector 30 comprises female and male connector members 31 and 41 of a conventional construction. Connection terminals of the male connector member 21 of the high-density multi-pole connector 10 can be respectively connected to and disconnected from connection terminals of the female connector member 11. Also, connection terminals of the male connector member 41 of the optional connector 30 can be respectively connected to and disconnected from connection terminals of the female connector member 31.

A female housing-side engagement portion 33 (described later), formed on a female housing 32 of the female connector member 31 of each optional connector 30, is releasably attached to a corresponding female frame-side engagement portion 13 (described later), formed on a female frame 12 of the female connector member 11 of the high-density multi-pole connector 10, from the upper side. As a result, the mating female connector members 11 and 31 can be combined together.

A male housing-side engagement portion 43 (described later), formed on a male housing 42 of the male connector member 41 of the optional connector 30, is releasably attached to a male frame-side engagement portion 23, formed on a male frame 22 of the male connector member 21 of the high-density multi-pole connector 10, for the lower side.

As a result, the mating male connector members 21 and 41 are combined together, and the thus combined male connector members 21 and 41 can be respectively inserted into and connected to the combined female connector members 11 and 31 at the same time. The female and male connector members 11 and 21 are fastened together by a bolt-nut arrangement 81. As a result, the female and male connector members 31 and 41 of the optional connector 30 are held by the female and male connector members 11 and 21 of the high-density multi-pole connector 10, and can not be removed alone, so that the connected condition of the connector device is maintained effectively.

In this embodiment unlike the above-mentioned conventional construction, the connection terminals of the female and male connector members of the high-density multi-pole connector 10, as well as the connection terminals of the female and male connector members of the optional connector 30, can be connected together at the same time.

Therefore, the connecting operation as well as a maintenance operation can be simplified and detection of the connected condition need only to be effected once. And besides, where the engagement portions 33 and 43 are provided respectively on the female and male housings 32 and 42 of the optional connector 30, the freedom of obtaining a space for mounting the optional connector 30 on the high-density multi-pole connector 10 is enhanced, and the connector can be used in a desired manner depending on the design of harness. Furthermore, there is no need to provide an empty connector portion in the frame of the high-density multi-pole connector 10, and the space efficiency can be greatly improved regardless of whether or not the optional connectors 30 are attached.

Next, the construction of the engagement portions 13 and 23 formed respectively on the female and male frames of the high-density multi-pole connector 10, as well as the construction of the engagement portions 33 and 43 formed respectively on the female and male frames of the optional connector 30, will now be described.

Figure 3:
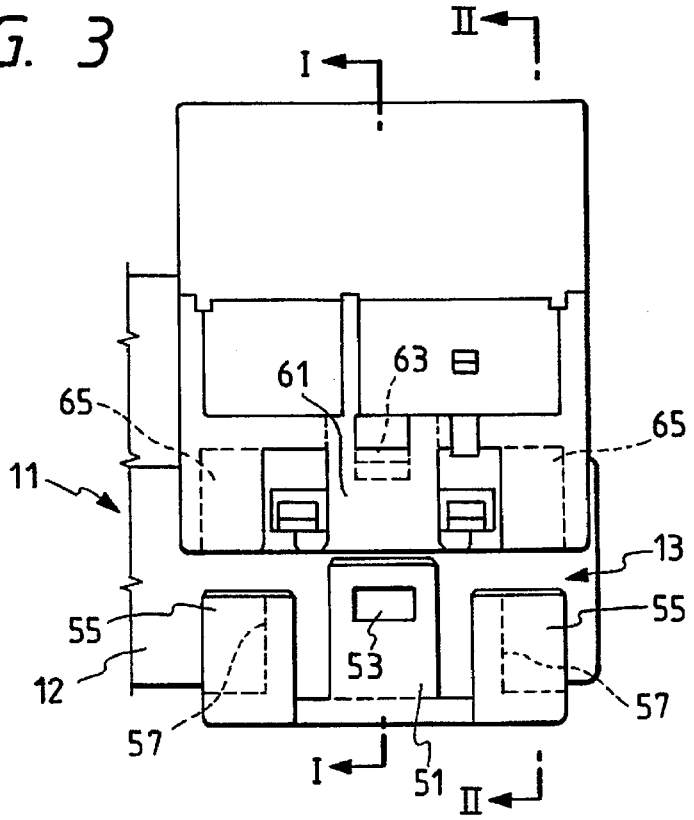
FIG. 3 is a front-elevational view of the connector of FIG. 1, showing a condition before a female connector housing of the optional connector is engaged.
Figure 4A:
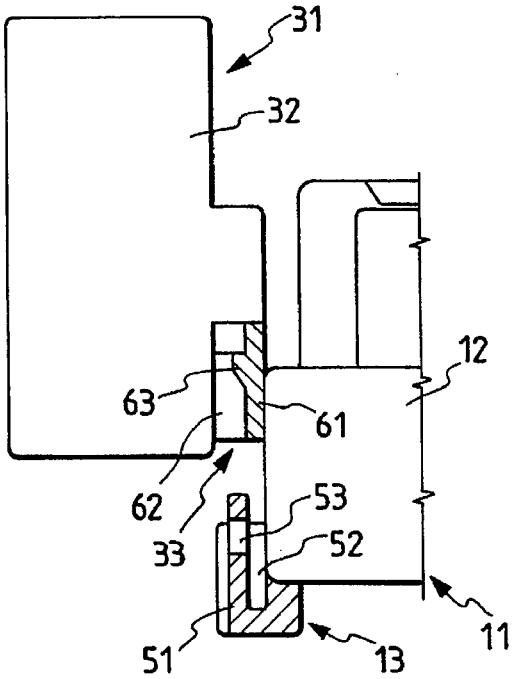
FIGS. 4*a* and 4*b* are partial cross-sectional views taken along the lines I—I and II—II of FIG. 3, respectively.
Figure 4B:
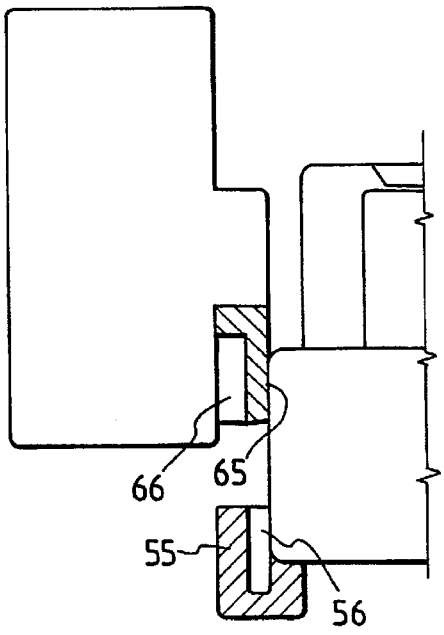
Figure 5:
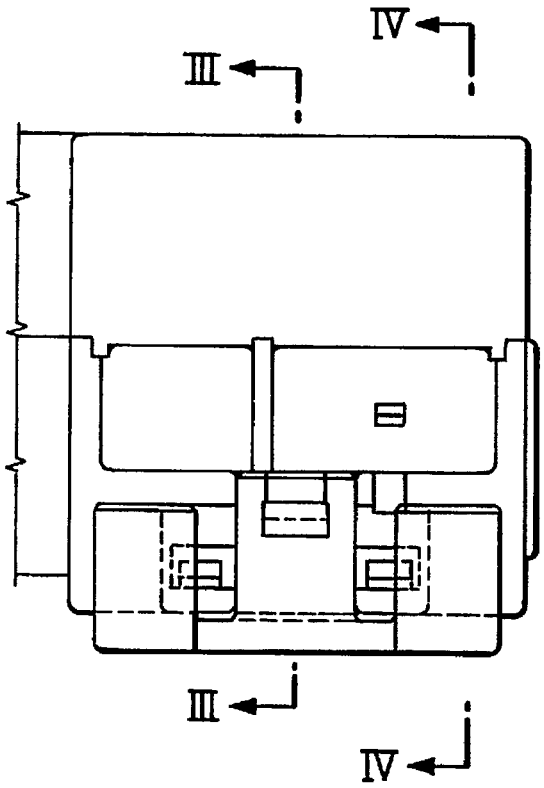
FIG. 5 is a front-elevational view similar to FIG. 3, but showing a condition after the engagement is effected.
Figure 6A:
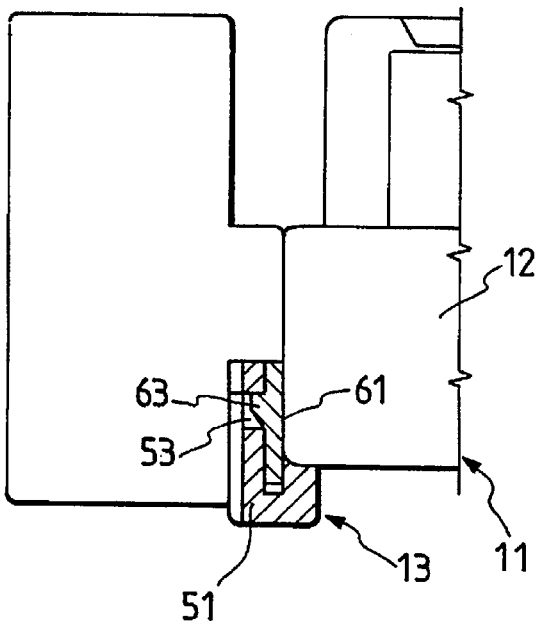
FIGS. 6*a* and 6*b* are partial cross-sectional views taken along the lines III—III and IV—IV of FIG. 5, respectively.
Figure 6B:
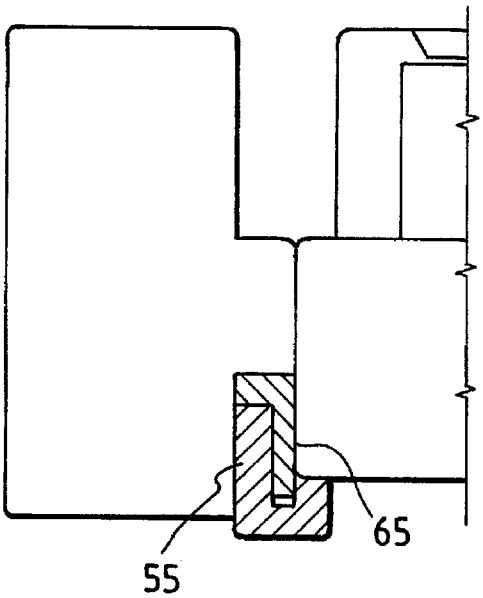

FIG. 3 is a front-elevational view showing a condition before the female housing of the optional connector is attached to the female frame of the high-density multi-pole connector, FIG. 4*a* is a partly cross-sectional view taken along the line I—I of FIG. 3, FIG. 4*b* is a partly cross-sectional view taken along the line II—II of FIG. 3, FIG. 5 is a front-elevational view showing a condition after the female housing is attached to the female frame of FIG. 3, FIG. 6*a* is a partly cross-sectional view taken along the line III—III of FIG. 5, and FIG. 6*b* is a partly cross-sectional view taken along the line IV—IV of FIG. 5.

Figure 7:
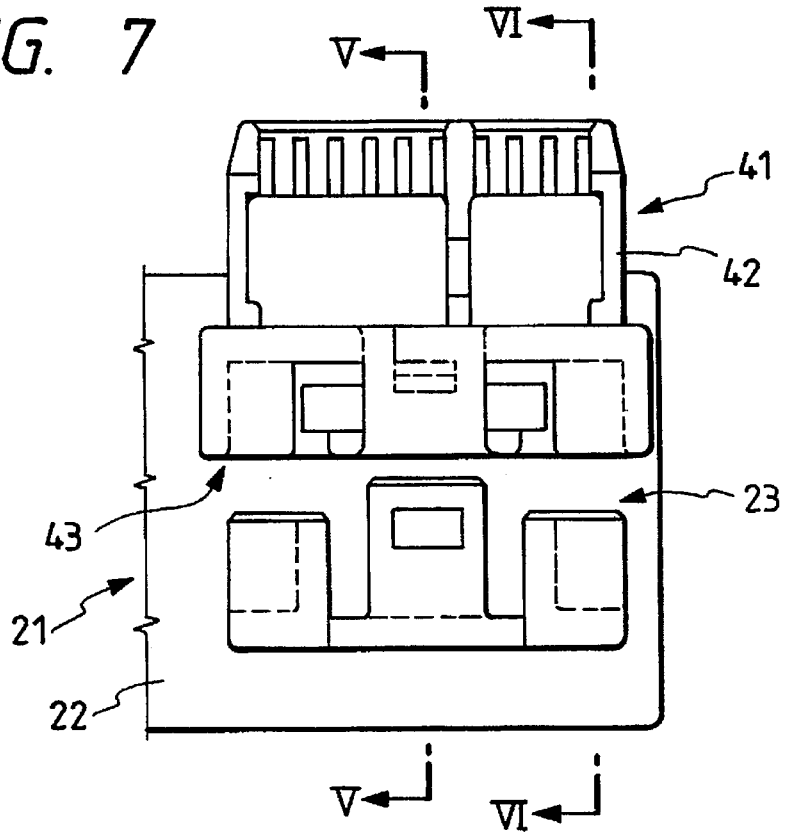
FIG. 7 is a front-elevational view showing a condition before a male housing of the optional connector is engaged.
Figure 8A:
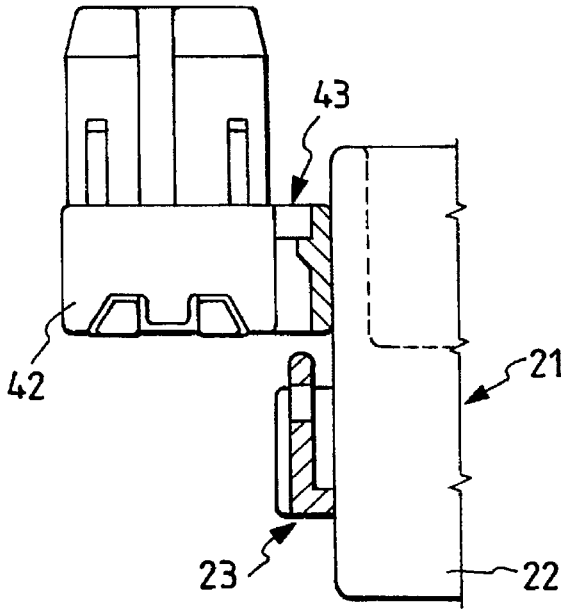
FIGS. 8*a* and 8*b* are partial cross-sectional views taken along the lines V—V and VI—VI of FIG. 7, respectively.
Figure 8B:
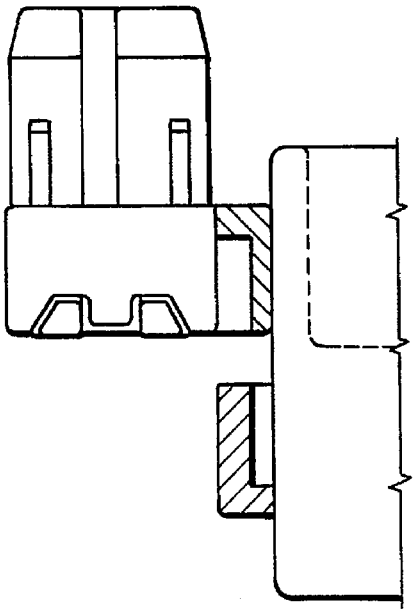
Figure 9:
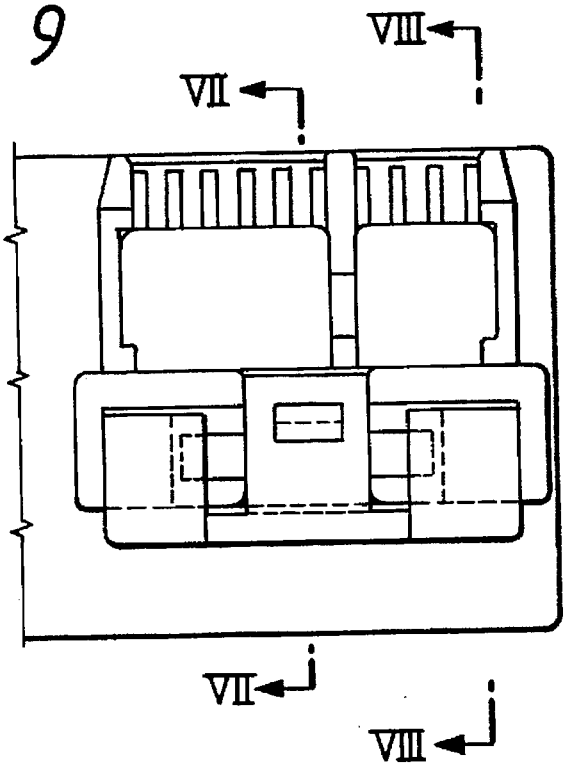
FIG. 9 is a front-elevational view similar to FIG. 7, but showing a condition after the engagement is effected.
Figure 10A:
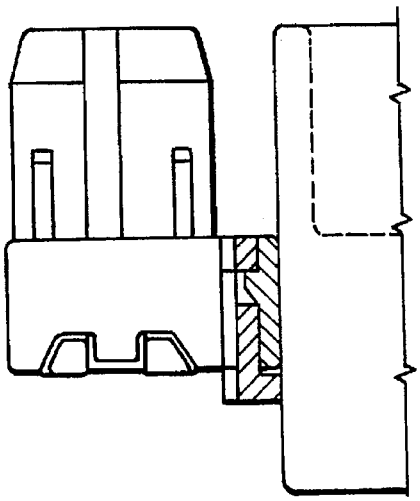
FIGS. 10*a* and 10*b* are partial cross-sectional views taken along the lines VII—VII and VIII—VIII of FIG. 9, respectively.
Figure 10B:
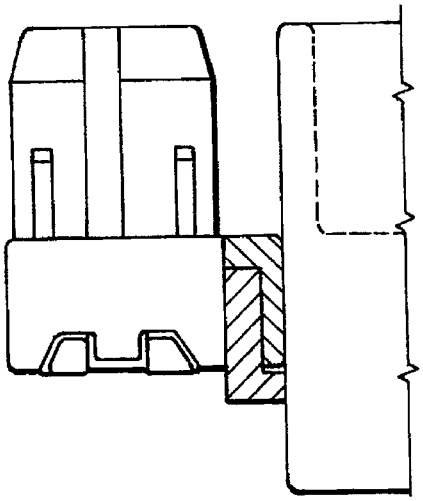

FIG. 7 is a front-elevational view showing a condition before the male housing of the optional connector is attached to the male frame of the high-density multi-pole connector, FIG. 8*a* is a partly cross-sectional view taken along the line V—V of FIG. 7, FIG. 8*b* is a partly cross-sectional view taken along the line VI—VI of FIG. 7, FIG. 9 is a front-elevational view showing a condition after the male housing is attached to the male frame of FIG. 7, FIG. 10*a* is a partly cross-sectional view taken along the line VII—VII of FIG. 9, and FIG. 10*b* is a partly cross-sectional view taken along the line VIII—VIII of FIG. 9.

Figure 11C:
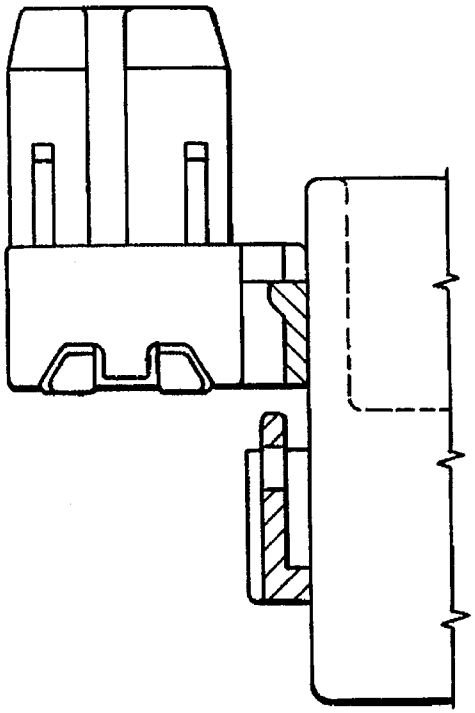
FIG. 11*a* to 11*c* are views explanatory of the process of disconnecting the female housing of the optional connector.
Figure 11B:
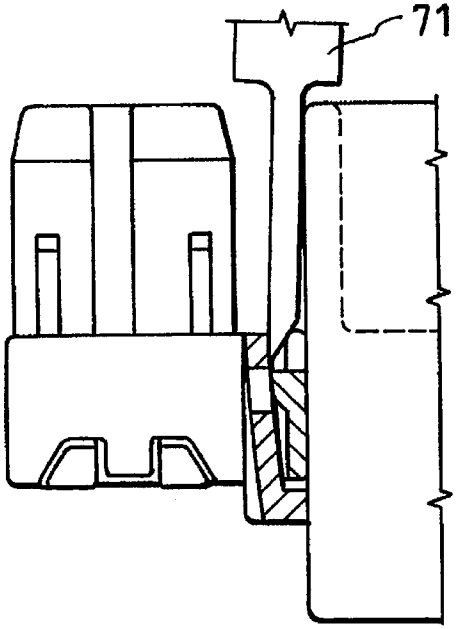
Figure 11A:
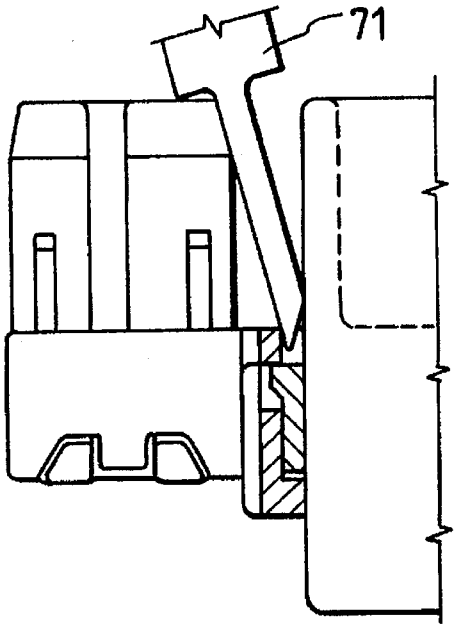
Figure 12:
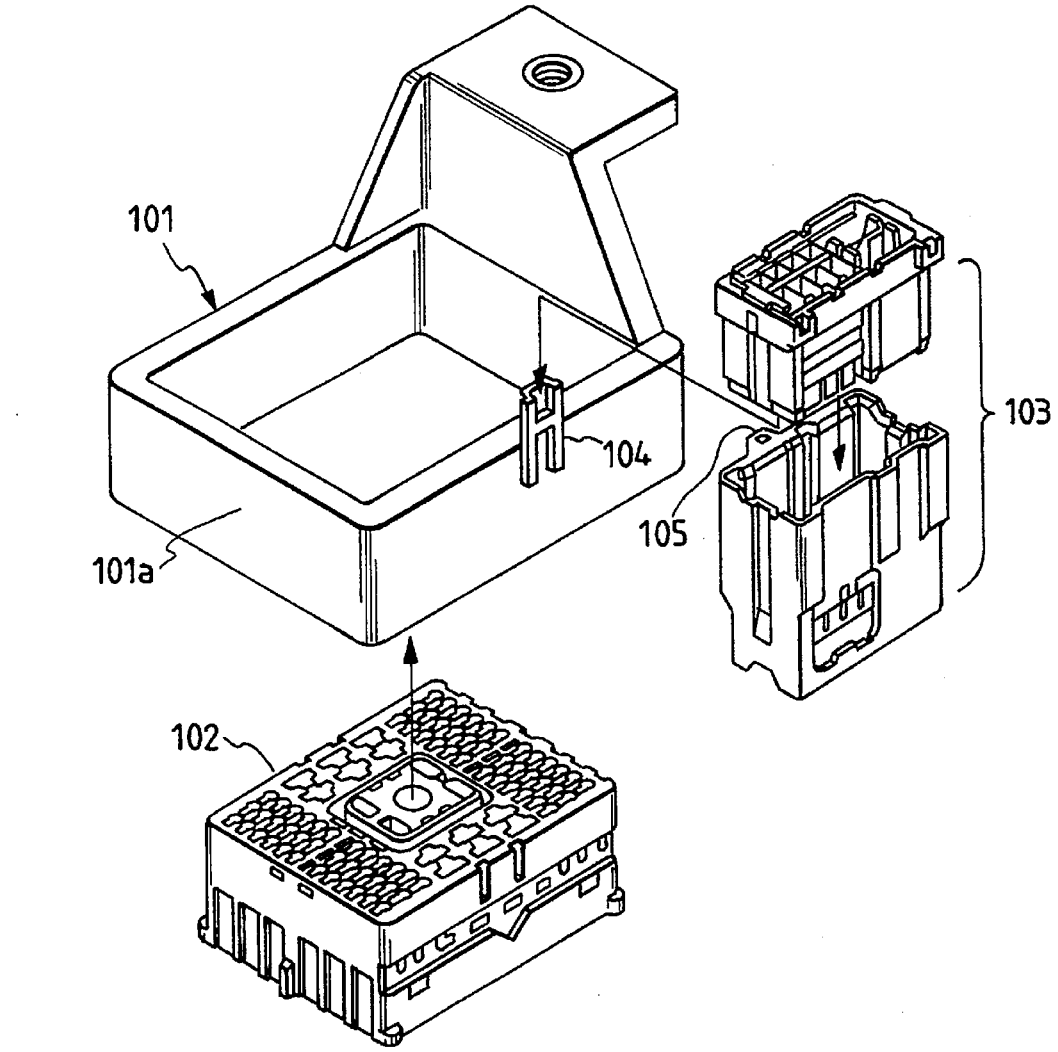
FIG. 12 is an exploded, perspective view showing one conventional construction of attaching an optional connector to a high-density multi-pole connector in juxtaposed relation thereto.

FIGS. 11*a* to 11*c* show the process of removing the female housing of the optional connector from the female frame of the high-density multi-pole connector of FIG. 5.

In the construction shown in FIGS. 1 to 10, the upwardly-directed female frame-side engagement portions 13 are formed on the female frame 12 of the female connector member 11 of the high-density multi-pole connector 10, as described above. The downwardly-directed male frame-side engagement portions 23 are formed on the male frame 22 of the male connector member 21. The downwardly-directed (shown upside down in FIGS. 7 to 10) female housing-side engagement portion 33 for being attached to the associated upwardly-directed female frame-side engagement portion 13 is formed on the female housing 32 of the female connector 31 of the optional connector 30. The upwardly-directed male housing-side engagement portion 43 for being attached to the associated downwardly-directed male frame-side engagement portion 23 is formed on the male housing 42 of the male connector member 41.

The female frame-side engagement portion 13 of the high-density multi-pole connector 10, as well as the male frame-side engagement portion 23, is bent to extend upwardly in such a manner that an engagement groove 52 is formed between the engagement portion and the outer surface of the frame. A lock piece portion 51, having an engagement hole 53 at an upper portion thereof, is provided. Frame-side guide piece portions 55 and 55 are provided respectively on opposite sides of the lock piece portion 51, and are bent to extend upwardly in such a manner that a guide groove 56 is formed between each guide piece portion 55 and the outer surface of the frame. The guide piece portions 55 and 55 have positioning walls 57 and 57 formed respectively at opposed sides thereof for limiting the movement in right and left directions.

The female housing-side engagement portion 33 of the optional connector 30, as well as the male housing-side engagement portion 43, extends downwardly to be received in the engagement groove 52 in such a manner that the engagement portion is spaced from the outer surface of the housing to form a space 62 therebetween for receiving the distal end portion of the frame-side lock piece portion 51. A housing side-lock piece portion 61, having an engagement projection 63 for being engaged in the engagement hole 53, is provided. Guide spaces 66 for respectively receiving the frame-side guide piece portions 55 and 55 are formed between the engagement portion and the outer surface of the housing, and are disposed on the opposite sides of the housing-side lock piece portion 61. Housing guide piece portions 65 and 65 extend downwardly, and are guided by the guide grooves 56 and 56, respectively, and the positioning walls 57 and 57 limit the movement of the guide piece portions 65 and 65 in right and left directions.

In this embodiment, in the condition shown in FIG. 3, FIGS. 4*a* and 4*b*, the female housing-side engagement portion 33, formed on the female housing 32 of the female connector member 31 of the optional connector 30, is first inserted into the female frame-side engagement portion 13 formed on the female frame 12 of the female connector member 11 of the high-density multi-pole connector 10. More specifically, the housing-side lock piece portion 61 is inserted into the engagement groove 52 formed by the frame-side lock piece portion 51, while guiding and limiting the movement of the housing-side guide pieces 65 and 65 by the right and left guide grooves 56 and 56 and positioning walls 57 and 57. Then, the engagement projection 63 on the housing-side lock piece portion 61 is engaged in the engagement hole 53 in the frame-side lock piece portion 51, thereby connecting the female connector member 11 of the high-density multi-pole connector 10 and the female connector member 31 of the optional connector 30 together in an integral manner, as shown in FIGS. 5, 6*a* and 6*b*.

In the condition shown in FIGS. 7, 8*a* and 8*b*, the male housing-side engagement portion 43, formed on the male housing 42 of the male connector member 41, is inserted into the male frame-side engagement portion 23 formed on the male frame 22 of the male connector member 21. The male connector member 21 of the high-density multi-pole connector 10 and the male connector member 41 of the optional connector 30 are connected together in an integral manner, as shown in FIGS. 9, 10*a* and 10*b*.

Then, the connected male connector members 21 and 41 of the high-density multi-pole connector 10 and the optional connector 30 are fitted in the connected female connector members 11 and 31, respectively, so that the connection terminals of the male and female connector members of the high-density multi-pole connector 10, as well as the connection terminals of the male and female connector members of the optional connector 30, are connected together at the same time. The fitted condition can be easily released by effecting an operation reverse to the above operation.

As shown in FIGS. 11*a* to 11*c*, for disengaging and disconnecting the female connector member 31 of the optional connector from the female connector member 11 of the high-density multi-pole connector, or male connector member 41 of the optional connector from the male connector member 21 of the high-density multi-pole connector, a front end of a removal tool 71 is inserted, and the distal end portion of the frame-side lock piece portion 51 is flexed outwardly by this tool to disengage the engagement projection 63 from the engagement hole 53, and then the female connector member 31 is removed from the female connector member 11.

The construction of the engagement portions in the above embodiment is provided as one example, and any other suitable construction may be adopted. Also, the combination of the male and female connector members is not limited.

As described above in detail, in the method and construction of fitting the optional connector relative to the high-density multi-pole connector according to the invention, the one connector member of the optional connector is releasably connected to the connector member of the high-density multi-pole connector in an integral manner, and the other connector member of the optional connector is releasably connected to the other connector member of the high-density multi-pole connector in an integral manner, and the integrally-connected one connector members are fitted and connected relative to the integrally-connected other connector members, respectively.

Therefore, the optional connector can be attached to the high-density multi-pole connector in juxtaposed relation thereto, and an increased number of required connectors can be easily dealt with satisfactorily, and the connection terminals of the one connector members are all connected respectively to the connection terminals of the other connector members at the same time.

What is claimed is:

1. A fitting structure, comprising:

a high-density multi-pole connector including a pair of first frame member and second frame member each of a unitary construction, said first frame member having a plurality of chambers for accommodating a plurality of male connector members, said second frame member having a plurality of chambers for accommodating a plurality of female connector members;

an optional connector including at least one pair of first connector member and second connector member;

a frame-side engagement member provided on an outer surface of each of said first frame member and said second frame member; and a housing-side engagement member provided on a housing of each of said first connector member and second connector member, wherein each of said housing-side engagement members is releasably engaged with one of said frame-side engagement members to thereby directly connect said first connector member to said first frame and said second connector member to said second frame.

2. A fitting structure, comprising:

a high-density multi-pole connector including a pair of first frame member and second frame member, said first frame member accommodated male connector members, said second frame member accommodated female connector members;

an optional connector including at least one pair of first connector member and second connector member;

a frame-side engagement member provided on an outer surface of each of said first frame member and said second frame member; and a housing-side engagement member provided on a housing of each of said first connector member and second connector member, wherein each of said housing-side engagement member is releasably engaged with said frame-side engagement member, wherein said frame-side engagement member includes a frame-side lock piece portion which is projected in a fitting direction of said male connector members and said female connector members, and has an engagement hole, said housing-side engagement member includes a housing-side lock piece portion which has an engagement projection, and wherein when each of said housing-side engagement member is engaged with said frame-side engagement member, said frame-side lock piece portion engaged with said housing-side lock piece portion, and then said engagement projection engaged in said engagement hole.

3. The fitting structure of claim 2, wherein a guide member is provided on at least one of said frame-side engagement member and said housing-side engagement member for guiding the other of said frame-side engagement member and said housing-side engagement member in a direction of connection.

4. A method of fitting a high-density multi-pole connector with an optional connector at the same time, said high-density multi-pole connector including a pair of first frame member and second frame member each having a unitary construction, said first frame member having a plurality of chambers for accommodating a plurality of male connector members, said second frame member having a plurality of chambers for accommodating a plurality of female connector members, said optional connector including at least one pair of first connector member and second connector member, said method comprising the step of:

attaching at least one pair of said first connector member and said second connector member directly to said first frame member and said second frame member, respectively; and fitting said male connector members to said female connector members.

5. The method of claim 4, wherein said attaching step comprises the step of engaging a frame-side engagement member provided on an outer surface of said first frame member and said second frame member respectively, at a housing-side engagement member provided on a housing of said first connector members and second connector members, respectively.

6. A method of fitting a high-density multi-pole connector with an optional connector at the same time, said high-density multi-pole connector including a pair of first frame member and second frame member, said first frame member accommodating male connector members, said second frame member accommodated female connector members, said optional connector including at least one pair of first connector member and second connector member, said method comprising the step of:

attaching at least one pair of said first connector member and said second connector member at said first frame member and said second frame member, respectively; and fitting said male connector members to said female connector members, wherein said attaching step comprises the step of engaging a frame-side engagement member provided on an outer surface of said first frame member and said second frame member respectively, at a housing-side engagement member provided on a housing of said first connector members and second connector members, respectively, wherein said frame-side engagement member includes a frame-side lock piece portion which is projected in a fitting direction of said male connector members and said female connector members, and has an engagement hole, said housing-side engagement member includes a housing-side lock piece portion which has an engagement projection, and wherein when each of said housing-side engagement member is engaged with said frame-side engagement member, said frame-side lock piece portion engaged with said housing-side lock piece portion, and then said engagement projection engaged in said engagement hole.

7. The method of claim 5, wherein a guide member is provided on at least one of said frame-side engagement member and said housing-side engagement member for guiding the other of said frame-side engagement member and said housing-side engagement member in a direction of connection.

* * * * *